US005464270A

United States Patent [19]

Chang

[11] Patent Number: 5,464,270

[45] Date of Patent: Nov. 7, 1995

[54] STAGELESS FOLDING DECK CHAIR

[76] Inventor: I-Shan, Chang, No. 184, Pu Tzpeu Wan-Chao Tsun, Chu-Chee Hsiang, Chia-Yi Hsien, Taiwan

[21] Appl. No.: 281,992

[22] Filed: Jul. 29, 1994

[51] Int. Cl.[6] ..... A47C 1/02

[52] U.S. Cl. ..... 297/81; 297/82; 297/68; 297/28

[58] Field of Search ..... 297/68, 80, 82, 297/27, 28, 81

[56] References Cited

U.S. PATENT DOCUMENTS 2,195,091 3/1940 Lorenz et al. ..... 297/27
3,099,478 7/1963 Pearlstine ..... 297/28

FOREIGN PATENT DOCUMENTS 0492371 4/1933 Canada ..... 297/28

*Primary Examiner*—Peter R. Brown
*Assistant Examiner*—Anthony Barfield
*Attorney, Agent, or Firm*— Peterson, Wicks, Nemer & Kamrath

[57] ABSTRACT

A stagelessly folding deck chair comprising a back frame, a seat frame pivotally connected with the back frame, a leg frame pivotally connected with the seat frame, two adjusting armrests each having an adjusting rod, and a support frame, wherein the adjusting rod is pivotally connected with both the leg frame and back frame so that when folding the chair, by means of controlling the adjusting rod, the back frame and leg frame are simultaneously moved to quicken the folding operation.

1 Claim, 6 Drawing Sheets

STAGELESS FOLDING DECK CHAIR

BACKGROUND OF THE INVENTION

The present invention relates to a stagelessly folding deck chair.

A conventional deck chair is designed with folding mechanism so that the deck chair can be folded in order to facilitate storage or carriage.

The conventional deck chair as shown in FIG. 1 generally includes a frame structure 9 composed of multiple hollow tube members. The frame structure 9 has a seat portion 91 and a back portion 92 which are associated with soft plastic boards or several pieces of fabric serving as supporting members 921 An adjusting plate 931 is disposed under an armrest 93 of the chair for adjusting an inclined angle of the back portion 92. A leg support frame 94 is pivotally connected to a front edge of the seat portion 91 so that a user's legs can rest on the leg support frame 94. The inclined angle of the leg support frame 94 is also adjustable to comfort the user.

While achieving the purpose of leisure, the conventional deck chair has several shortcomings as follows:

1. When using the deck chair, the back portion and leg support frame must be adjusted respectively. Therefore, the user often cannot quickly complete the adjustment. Moreover, the back portion and leg support frame often cannot be adjusted to a comfortable position to safisfy the user.

2. When adjusting the inclined angle of the back portion, the adjusting plate located under the armrest is operated in cooperation with the frame structure. The adjusting plate is exposed outside and must be operated by one hand with the other hand gripping the armrest. Therefore, the other hand may be clamped and hurt due to incaution during the adjusting procedure.

3. The back portion is locked after adjusted and in case the user is not comfortable with the inclined angle of the back portion, the back portion must be re-adjusted. In addition, in case it is desired to place down the leg support frame after adjusted, the leg support frame must be first pivoted to an upmost position and then pivoted down. Such procedure is inconvenient to the user.

4. Before folding or stretching the deck chair, the adjusting plate must be first adjusted to a top position or a bottom position thereof. This is troublesome to the user.

5. The adjusting plate has several adjusting holes arranged at fixed intervals so that the adjusting angle is fixed and it may be impossible to achieve an optimal inclined angle for the user.

SUMMARY OF THE INVENTION

It is a primary object of the present invention to provide a stagelessly folding deck chair comprising a back frame, a seat frame pivotally connected with the back frame, a leg frame pivotally connected with the seat frame, two adjusting armrests each having an adjusting rod, and a support frame. The adjusting rod is slidably disposed in a slide groove of the armrest and pivotally connected with both the leg frame and back frame. By means of controlling the adjusting rod, the inclined angles of the back frame and leg frame are simultaneously stagelessly adjusted.

It is a further object of the present invention to provide the above deck chair, wherein the adjusting rod is hidden inside the armrest so that when operating the adjusting rod with a user's hand, the hand is protected from being clamped and hurt by the adjusting rod.

It is still a further object of the present invention to provide the above deck chair, wherein when a user sits on the chair, the weight of the user will make the back frame pivot downward through a certain angle and make the leg frame simultaneously pivot upward through a certain angle in accordance with the angle of the back frame so as to convert the chair from a sitting state into an optimally comfortable lying state.

The present invention can be best understood through the following description and accompanying drawings, wherein:

DETAILED DESCRIPTION OF THE PREFERRED EMBODIMENT

Figure 1:
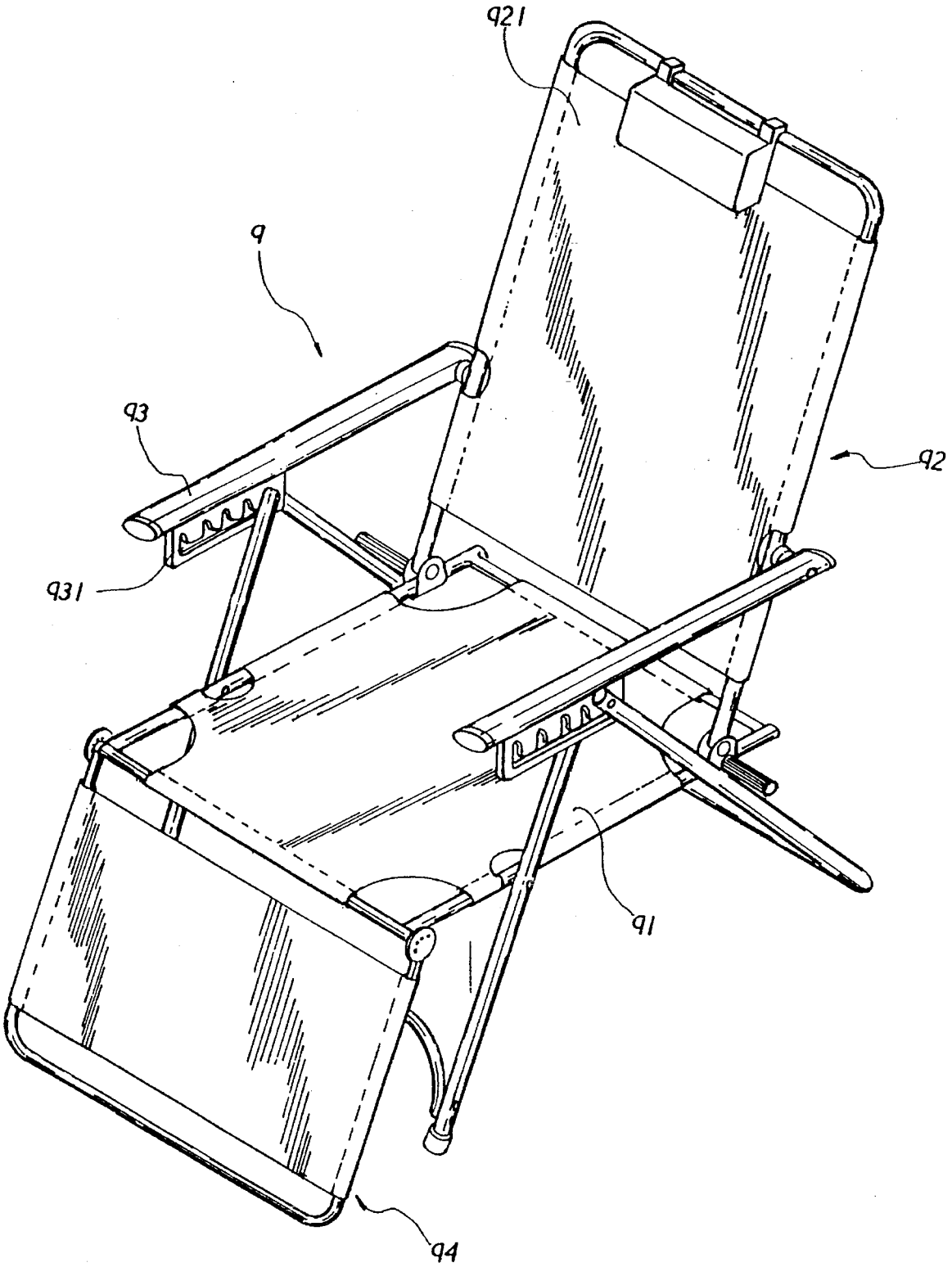
FIG.1 PRIOR ART
FIG. 1 is a perspective view of a conventional folding deck chair.
Figure 2:
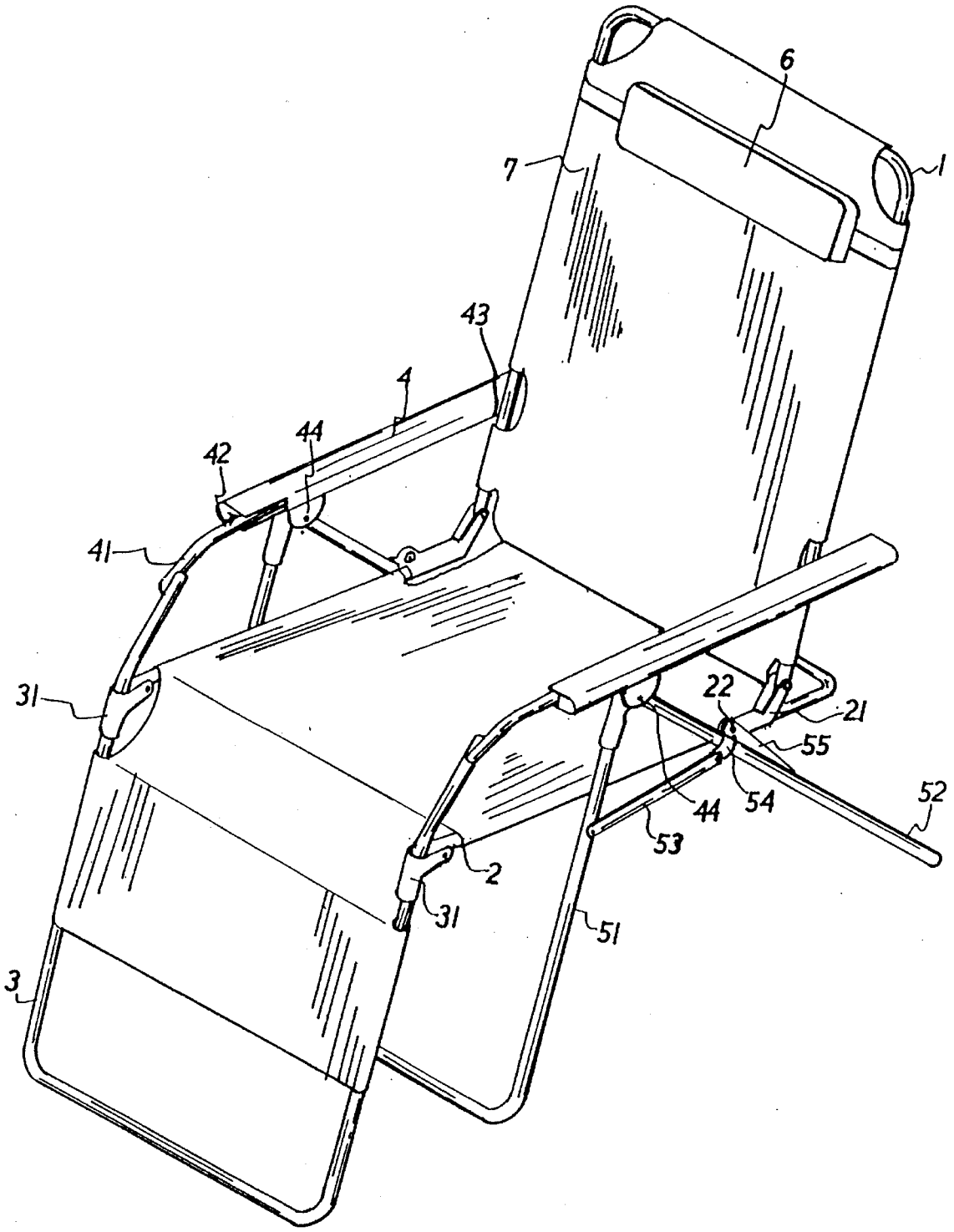
FIG. 2 is a perspective view of the present invention.

Please refer to FIG. 2. The statelessly folding deck chair of the present invention mainly includes a back frame 1, a seat frame 2, a leg frame 3, two adjusting armrests 4, a support frame 5, a pillow 6 and support sheets 7.

The back frame 1, seat frame 2 and leg frame 3 are all composed of circular tube members. The leg frame 3 is pivotally connected with the seat frame 2 by two pivot brackets 31. The seat frame 2 is U-shaped, having two rear fixing bracket 22 each having a flange section 2 on which the back frame 1 is pivotally connected.

Figure 3:
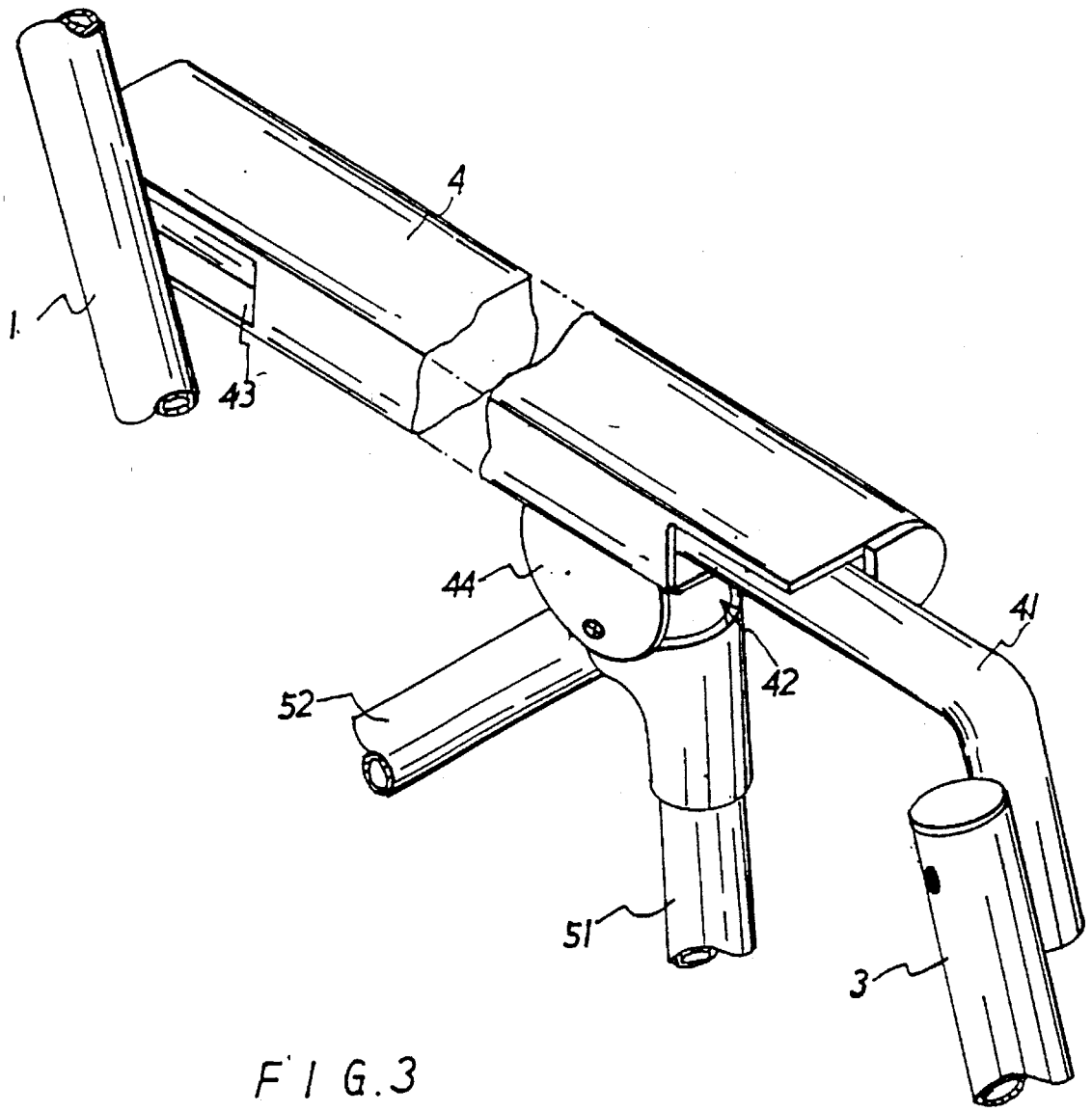
FIG. 3 is a perspective view, showing the adjusting armrest of the present invention.

The adjusting armrest 4 is a rectangular tube member, having a lateral slide groove 42 and a rear engaging channel 43 as shown in FIG. 3.

The support frame 5 includes a front portion 51 and a rear portion 52 which are both U-shaped and connected with each other by two first linking levers 53.

Figure 4:
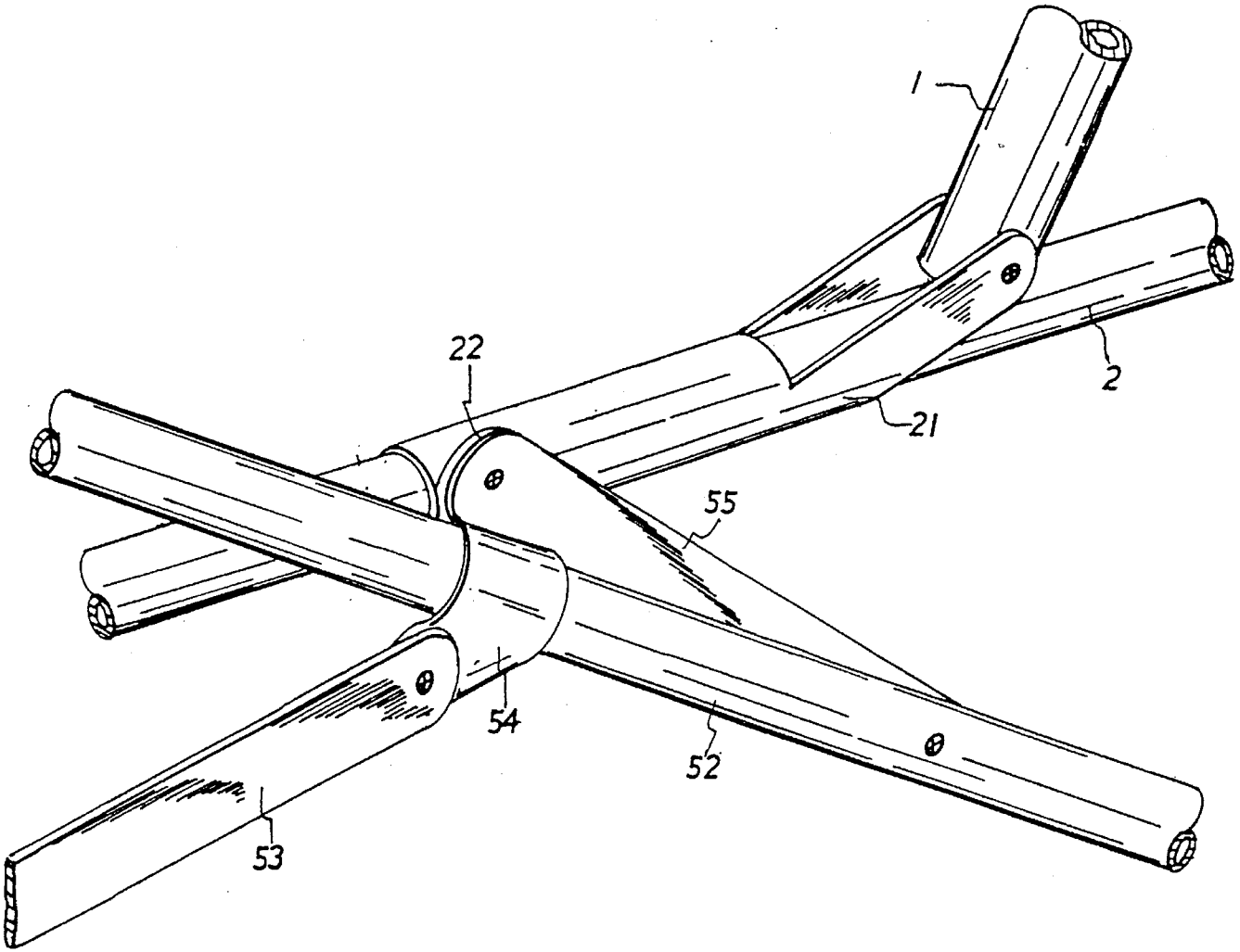
FIG. 4 is a perspective view, showing the support frame of the present invention.
Figure 6:
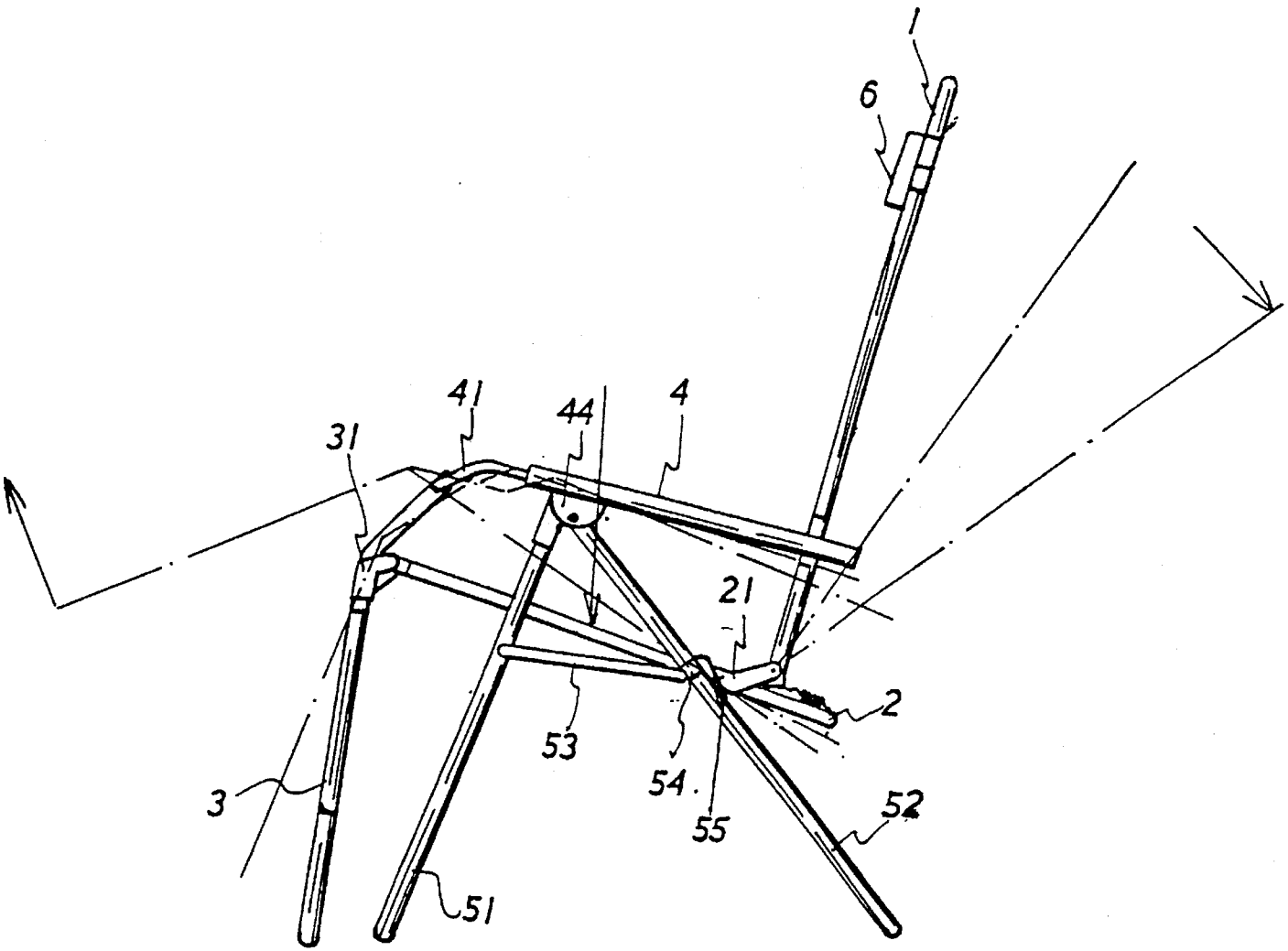
FIG. 6 shows the movement of the present invention in operation.

Please refer to FIGS. 3, 4 and 6. A pivot seat 44 is disposed under the armrest 4 for pivotally connecting the front portion 51 and rear portion 52 of the support frame 5 with the armrest 4. The front and rear portion 51, 52 of the support frame 5 stand on the ground with one end of the first linking lever 53 pivotally connected with a section of the front portion 51 and the other end of the linking lever 53 pivotally connected with a substantially U-shaped locking bracket 54 one end of bracket 54 is connected with a second linking lever 55. A first end of lever 55 is pivotly connected to the bracket 22 of the seat frame 2. The second end of the second linking lever 55 is pivotally connected with a lower section of the rear portion 52 of the support frame 5 by shaft 58. The U-shaped portion of bracket . The block 54 snugly abuts against the rear portion 52 of the support frame 5 when it is fully opened. The front and rear portions 51, 52 of the support frame 5 together with the first linking lever 53 form an A-shaped frame body which is able to stably stand on the ground when so fully opened.

As shown in FIG. 3, an adjusting rod 41 is disposed in the slide groove 42 of the armrest 4. The adjusting rod 41 is circular tube-like, having a front end which is slightly bent downward and a rear end pivotally connected with a section of the back frame 1. Referring to FIGS. 2 and 4, a lower end of the back frame 1 is pivotally connected with the fixing bracket 21 of the seat frame 2 and a front end of the seat frame 2 is pivotally connected with the pivot bracket 31 of the leg frame 3.

The support sheets 7 are disposed on the back frame 1, seat frame 2 and leg frame 3 and stretched into a smooth and plane state by a resilient belt (not shown). The pillow 6 is tied on the back frame 1 by a resilient tying belt.

According to the above arrangements, when a user sits on the chair, the gravity center of the user resides in the seat frame 2. The chair bears the weight of the user in a manner as shown in FIG. 6, wherein when the gravity center of the user is placed on the seat frame 2, the back of the user exerts a downward force on the back frame 1 and an upward force on the leg frame 3. Thus, when a user sits on the chair the weight of the user will make the back frame 1 pivot downward through a certain angle and make the leg frame simultaneously pivot upward through a certain angle in accordance with the angle of the back frame so as to convert the chair from a sitting state into a lying state. Thus, with the flange 22 of the seat frame 2 serving as a fulcrum, when the adjusting rod 41 slides rearward in the slide groove 42, the first and second linking levers 53, 55 hold support frame 5 fully open, while the back frame 1, seat frame 2 and leg frame 3 are simultaneously moved to convert the chair into a lying state. The inclined angle of the lying chair can be stagelessly adjusted by controlling the adjusting rod 41. Because the support frame 5 is such designed that the gravity center of the user will always fall within a central area of the support frame 5, the lying chair can still stably bear the weight of the user without liability of tilting over. Therefore, the chair of the present invention can be safely used in both sitting state and lying state.

Figure 5:
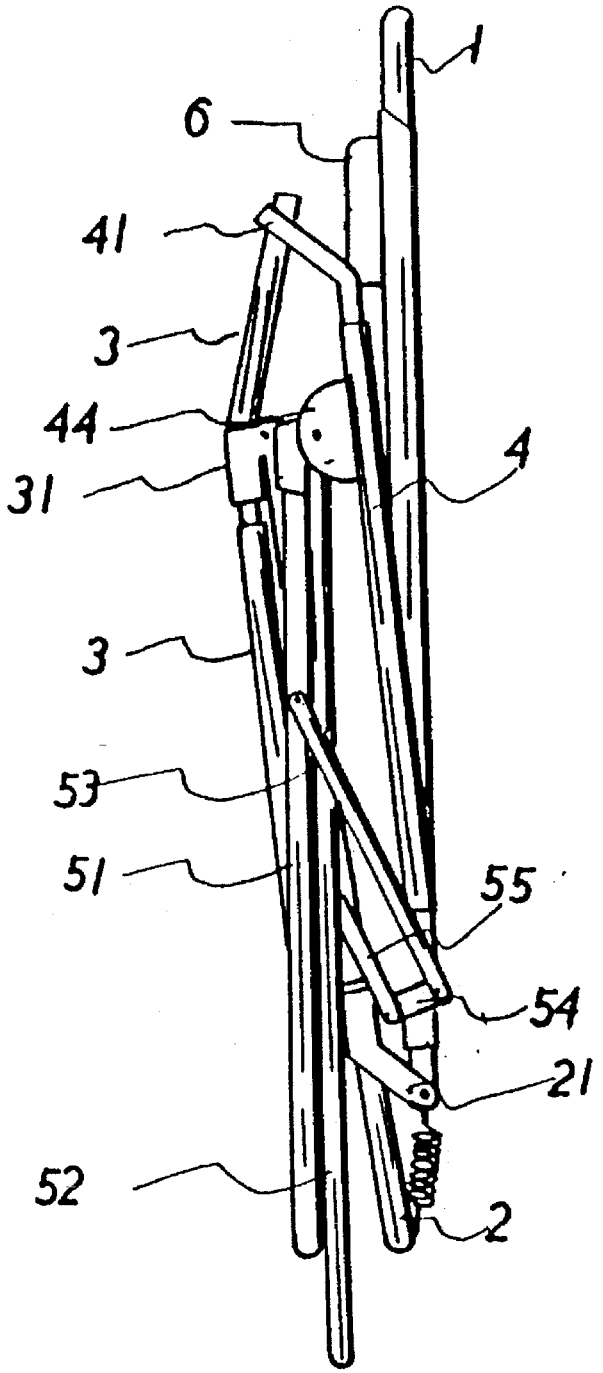
FIG. 5 shows the present invention in a folded state.

In addition, the adjusting rod 41 is pivotally connected with both the leg frame 3 and back frame 1 so that when the chair is folded, the back frame 1 and leg frame 3 will be simultaneously moved to quicken the folding operation as shown in FIG. 5.

In conclusion, the inclined angle of the deck chair of the present invention can be stagelessly adjusted by means of the adjusting rod 41 and slide groove 42 of the armrest 4. Also, the support frame 5 is able to stably and safely support the user without liability of tilting over.

The above preferred embodiment is only an example of the present invention and the scope of the present invention should not be limited to the example. Any modification or variation derived from the example should fall within the scope of the present invention.

What is claimed is:

1. A stagelessly folding deck chair comprising a back frame, a seat frame, a leg frame, two adjusting armrests, a support frame, a pillow and support sheets, wherein:

said back frame, seat frame and leg frame are all composed of circular tube members and said leg frame is pivotally connected with a front end of the seat frame by two pivot brackets, said seat frame being U-shaped, having two rear fixing brackets each having a flange section on which a lower end of said back frame is pivotally connected;

each of said adjusting armrests being a rectangular tube member, having a lateral slide groove and a rear engaging channel;

said support frame having a front portion and a rear portion which are both U-shaped and respectively connected with each other by two first linking levers, a pivot seat being disposed under each of said armrests for pivotally connecting said front portion and rear portion of said support frame with said armrests, said front and rear portion of said support frame standing on the ground with a first end of each of said first linking levers pivotally connected with a section of said front portion and a second end of each of said first linking levers pivotally connected with a substantially U-shaped locking block, an end of said locking block being integrally formed with a first end of a second linking lever, said first end of the second linking lever being pivotally connected to said seat frame on each of said two rear fixing brackets, and a second end of said second linking lever being pivotally connected with a lower section of said rear portion of said support frame, a U-shaped portion of each said locking block snugly abutting against said rear portion of said support frame when fully opened, an adjusting rod being disposed in said slide groove of each of said armrests, said adjusting rod having a front end which is slightly bent downward pivotally connected to said leg frame at a point vertically spaced from said pivot brackets and a rear end pivotally connected with a section of said back frame, whereby when said adjusting rod slides rearward in said slide groove, said each of first linking lever and said second linking lever holds said support frame fully open to allow inclined angles of said back frame, seat frame and leg frame to be simultaneously stagelessly adjusted to convert the chair into a lying state for stably bearing the weight of a user.

* * * * *